US006997671B2

(12) United States Patent
Rühli

(10) Patent No.: US 6,997,671 B2
(45) Date of Patent: Feb. 14, 2006

(54) SEPARATING ARRANGEMENT FOR A CARTONING MACHINE

(75) Inventor: Walter Rühli, Schaffhausen (CH)

(73) Assignee: Robert Bosch GmbH (DE)

( * ) Notice: Subject to any disclaimer, the term of this patent is extended or adjusted under 35 U.S.C. 154(b) by 69 days.

(21) Appl. No.: 10/643,134

(22) Filed: Aug. 18, 2003

(65) Prior Publication Data

US 2004/0042892 A1 Mar. 4, 2004

(30) Foreign Application Priority Data

Aug. 27, 2002 (CH) ..... 1461/02
Oct. 30, 2002 (CH) ..... 1825/02

(51) Int. Cl.
*B65G 61/00* (2006.01)

(52) U.S. Cl. ..... 414/798.9; 414/728; 414/737; 414/773; 414/783

(58) Field of Classification Search ..... 414/728, 414/737, 773, 783, 798.9
See application file for complete search history.

(56) References Cited

U.S. PATENT DOCUMENTS 4,566,846 A 1/1986 Cartwright ..... 414/742
4,863,340 A * 9/1989 Masunaga et al. ..... 414/789.5
5,395,205 A * 3/1995 Dugas et al. ..... 414/728

FOREIGN PATENT DOCUMENTS

DE 3735851 A1 * 5/1989
DE 199 14 578 10/2000
EP 1 184 161 3/2002

* cited by examiner

*Primary Examiner*—Douglas Hess
(74) *Attorney, Agent, or Firm*—Harness, Dickey & Pierce, P.L.C.

(57) ABSTRACT

A separating arrangement for the individual removal of carton blanks (Z) from a magazine (M) and for shifting the removed carton blank (Z) from a removal position into a transfer position has a motor-driven pivoting arm (5) and means (6) arranged thereon for removing the carton blank (Z) on its own. The pivoting arm (5) is arranged on a carriage (2) which can be displaced in a rectilinear manner, it being the case that, as the carton blank (Z) is removed and shifted, a pivoting movement of the pivoting arm (5) is superposed by a rectilinear movement of the carriage (2). This arrangement thus allows space-saving and efficient shifting of individual carton blanks and, in addition, can be integrated in a flexible manner in cartoning machines.

14 Claims, 6 Drawing Sheets

SEPARATING ARRANGEMENT FOR A CARTONING MACHINE

TECHNICAL FIELD

The invention relates to a separating arrangement for a cartoning machine, in particular a carton erector.

DISCUSSION

A wide range of different cartoning machines for forming boxes from carton blanks are known in the prior art. Use is usually made of so-called carton erectors in which the carton blanks are bent into the desired shape from a horizontal starting position. These machines essentially comprise a magazine, in which the carton blanks are stacked, a separating arrangement for the removal of individual carton blanks, and an erecting mechanism with a forming ram for forming the blank into the desired box. Conveyors are usually provided upstream and downstream of the erecting mechanism in order to convey the carton blank into the erecting mechanism and to convey the finished box out of the erecting mechanism.

The carton blanks are located either more or less horizontally or more or less vertically in the magazine stack. In the latter case, they each have to be pivoted through 90° into a horizontal position by means of the separating arrangement before they can be transferred to the erecting mechanism. Since the amount of time required for transferring the carton blanks from the magazine to the erecting mechanism has a significant influence on the output capacity of the machine as a whole, this shifting operation should be as straightforward as possible but, nevertheless, should allow shifting which is as precise as possible.

EP-A-1,184,161 thus discloses a machine which is intended for erecting boxes from carton blanks and of which the separating arrangement has a rotatable, two-part arm. The axis of rotation of the arm is located beneath the transporting path, with the result that it does not collide with other machine components. The two parts of the arm are connected to one another in an articulated manner and can be pivoted in relation to one another by means of a controlled drive. The free arm part is provided with vacuum suckers and only serves for withdrawing the carton blank from the stack, that is to say for separating purposes. The second arm part only serves for transferring the blank into a horizontal position. In this position, the vacuum suckers release the carton blank, with the result that the latter can be deposited on a conveying path leading to the erecting mechanism. The endless circular operation of the separating arrangement does indeed reduce the amount of time required for shifting the carton blanks. The arrangement, however, has the disadvantage that, as before, a relatively large amount of space is required for separating and transfer purposes. In addition, the separating arrangement is of non-flexible configuration, with the result that the following conveying path has to be adapted in order to allow the arrangement to be integrated in the machine as a whole.

EP-A-0,825,111 discloses a machine which is intended for erecting boxes and in the case of which the separating arrangement likewise has a multi-part arm. A bottom arm part moves up and down along a curved path. In addition, it is connected via a strut, which can be changed in length, to a top, pivotable arm which is provided with vacuum suckers, in order to remove a carton blank from the magazine stack and pivot it into a horizontal position.

Furthermore, EP-A-0,761,535 discloses a packaging machine for erecting, filling and closing cartons. In this case, either straightforward carton blanks or carton blanks which have already been adhesively bonded, but are folded flat, are transported into a filling station by way of a removal arrangement. In first embodiments, the removal arrangement has a two-armed removal framework which is provided with a vacuum sucker and is fastened on a carrying arm. The carrying arm is mounted such that it can be pivoted through approximately 90° in a carriage which can be displaced in the horizontal direction, and serves for conveying the already shifted blank to the filling station. The pivoting arm is thus pivoted in the first instance, and only then does the displacement of the carriage take place. In the other embodiments, the removal framework, for shifting purposes, is moved up and down rather than being pivoted. These removal arrangements require a relatively large amount of space. Since they additionally transport the blanks to the filling station, the output capacity of the packaging machine is seriously limited.

SUMMARY OF THE INVENTION

It is an object of the invention to provide a separating arrangement for a cartoning machine, in particular a carton erector, which is of space-saving design, can be integrated in a flexible manner in the cartoning machine and allows efficient shifting of carton blanks.

This object is achieved by an arrangement having the features of patent claim 1.

The separating arrangement according to the invention serves for the individual removal of carton blanks from a magazine and for shifting the removed carton blank from a removal position into a transfer position. The arrangement has a motor-driven pivoting arm and means arranged thereon for removing the carton blank on its own, and is defined in that the pivoting arm is arranged on a carriage which can be displaced in a rectilinear manner, it being the case that, as the carton blank is removed and shifted, a pivoting movement of the pivoting arm is superposed by a rectilinear movement of the carriage.

The arrangement according to the invention thus simultaneously combines a pivoting movement with a translatory movement. The act of removing and shifting an individual carton blank is a flowing movement in the case of which the pivoting arm is rotated through the desired angle and simultaneously pushed back and forth. It is thus possible for its position in relation to the remaining stack to be adjusted in each case such that that edge of the removed carton blank which is located closest to the stack is always as close as possible to the top surface of the stack. In addition, the shifting movement, that is to say the pivoting movement, may be started just after the removal. The act of shifting the carton blank from its vertical position into a horizontal position can thus be realized within a minimal amount of space, since it can move over an optimized three-dimensional curve. The separating installation may thus be of space-saving and compact design. In addition, the amount of time required for removal and shifting purposes is also minimized.

The path of the carriage may be any desired length, with the result that, following rotation of the arm, the carriage can additionally execute a purely translatory movement in order to bring the removed carton blank to the desired transfer location. The separating arrangement can thus be integrated straightforwardly in cartoning machines.

Superposing a pivoting movement with a translatory movement, in addition, has the advantage that this is easy to realize in control terms.

In a preferred embodiment, the pivoting arm is of rigid, in particular angled, design. This simplifies the activation and additionally reduces the production costs.

In order for the separating arrangement to be flexible in respect of changing the carton-blank shapes, the means arranged on the pivoting arm are preferably arranged such that they can be displaced and fixed in their respective position.

The means are preferably arranged such that the carton blank is gripped at at least four, preferably precisely four, locations. This allows better destacking and good guidance when the blank is shifted. The destacking is also, or additionally, improved by the means being resiliently mounted.

Further advantageous embodiments can be gathered from the dependent patent claims.

BRIEF DESCRIPTION OF THE DRAWINGS

The subject matter of the invention is explained hereinbelow with reference to preferred exemplary embodiments which are illustrated in the attached drawing, in which.

DESCRIPTION OF THE PREFERRED EMBODIMENTS

The separating arrangement described hereinbelow is a constituent part of a cartoning machine, in particular of a carton erector and/or lidder. Such cartoning machines are known in the prior art and are thus not described in detail hereinbelow. As mentioned in the introduction, they essentially comprise a magazine with a stack of flat carton blanks, a separating arrangement, an erecting mechanism and at least one conveyor. The separating arrangement is generally arranged on a framework of the machine. It is also possible, however, to provide it with a dedicated framework. These frameworks are neither shown nor described hereinbelow.

Figure 1B:
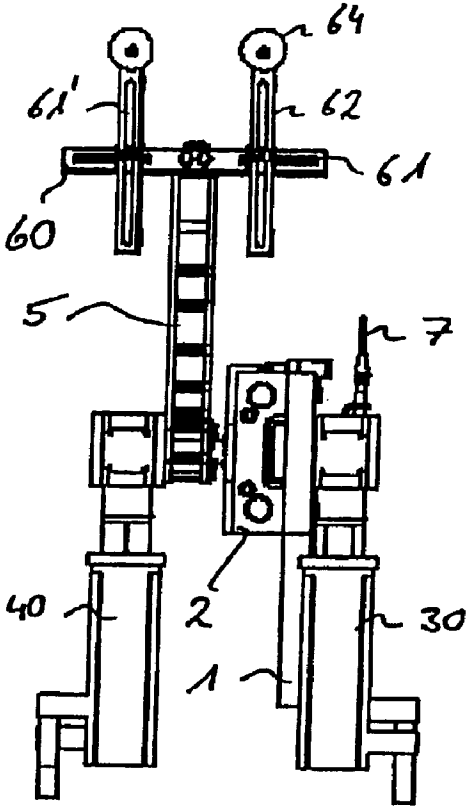
FIG. 1*b* shows a front view of the arrangement according to FIG. 1*a;*
Figure 1A:
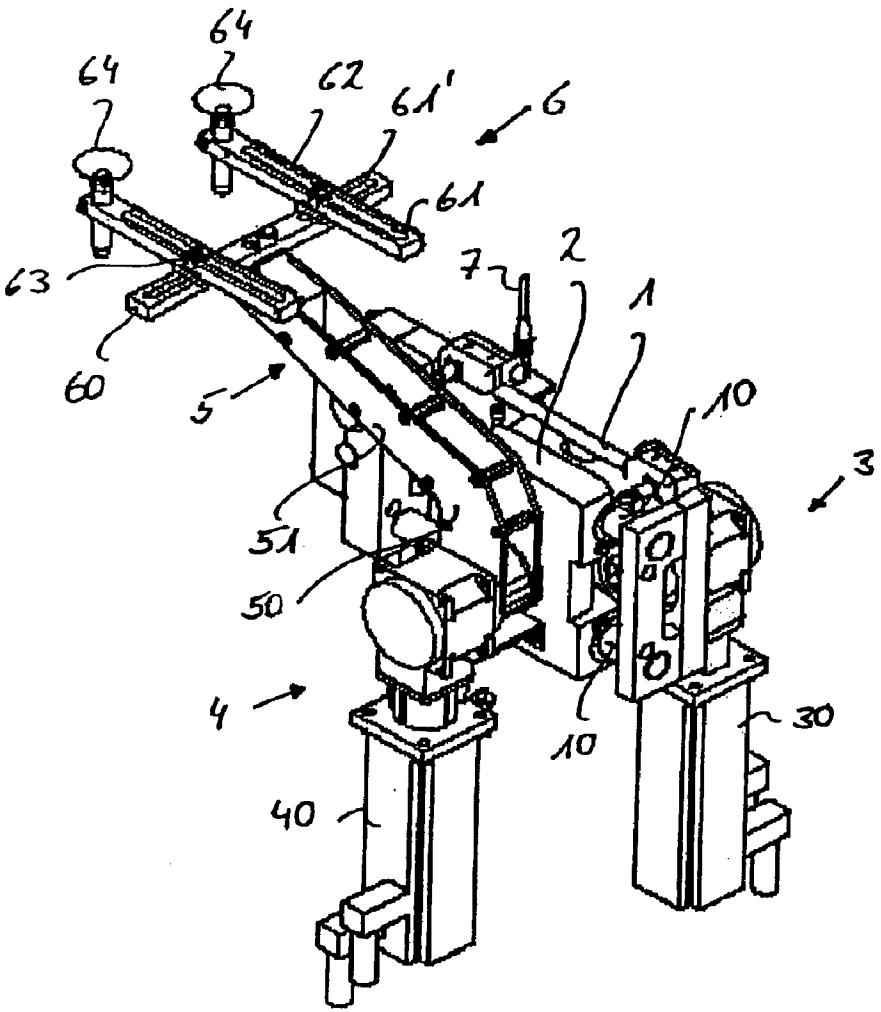
FIG. 1*a* shows a perspective illustration of a first embodiment of the separating arrangement according to the invention.

FIGS. 1*a* and 1*b* illustrate a first embodiment of the separating arrangement according to the invention. It has a carriage frame 1 which can be fastened on the abovementioned framework. The carriage frame 1 has at least one guide rod 10. In this case, there are two guide rods 10. A carriage 2 is mounted such that it can be displaced in a rectilinear manner on said guide rods 10. The carriage 2 is driven by means of a translatory drive unit 3. This drive unit 3 has a first motor 30, of which the drive shaft is connected to a first drive roller 31, preferably a gearwheel. The first motor 30 is preferably a servomotor with an angular drive. A first endless belt 33, preferably a first toothed belt, connects the first drive roller 31 to a first deflecting roller 32, which is likewise preferably a gearwheel. The carriage 2 is firmly connected to the first endless belt 33. Other known kinds of translatory drive for the carriage, however, are also possible.

In this example, the drive shaft of the first motor 30 runs perpendicularly to the displacement direction of the carriage 2, that is to say the carriage 2 moves back and forth at least more or less horizontally and the drive shaft runs vertically. The basic position of the carriage 2 is detected by means of a sensor 7.

A motor-driven pivoting arm 5 is arranged on the carriage 2. The pivoting arm 5 is driven by means of a rotary drive unit 4, which is likewise fastened on the carriage 2. This unit 4 has a second motor 40, preferably likewise a servomotor with angular drive. In the example illustrated here, the drive shaft of the second motor 40 runs in the vertical direction and the pivoting arm 5 is connected to a horizontally running deflecting spindle. The two motors 30, 40 are connected to a control means S of the cartoning machine. If the cartoning machine is operated cyclically, then the drives of the pivoting arm 5 and of the carriage 2 are also operated cyclically, preferably in time with the rest of the machine and/or of the erecting mechanism.

The pivoting arm 5 is preferably of rigid design and of angled form. The arm 5 here has two legs of different length, the first, shorter leg 50 being connected to the drive. The second, longer and free leg 51 projects beyond the carriage 2 and is provided with means for removing carton blanks. For this purpose, use may be made of all means which are suitable for gripping and for securing the carton blank as it is shifted. Use is preferably made, however, of vacuum suckers connected to a negative-pressure source. In this example, the abovementioned means thus comprise a sucker mount 6 and at least one vacuum sucker 64. In order for it to be possible to adapt the position of the at least one vacuum sucker 64, in particular in accordance with the type of cartoning machine and the shape of the carton blanks, the sucker mount 6 has a carrier bar 60 and at least one sucker strip 62. In this case, there are two sucker strips 62, each having at least one, in this case precisely one, suction cup 64. The carrier bar 60 is fixed to the free end of the pivoting arm 5 such that it runs transversely to the longitudinal direction of the latter. The sucker strips 62 are arranged on the carrier bar 60 such that they run parallel to the longitudinal direction of the pivoting arm 5, it being possible for them to be displaced, within displacement grooves 61, 61', in two perpendicular directions and to be fixed in their respective position by a fastening means 63, preferably by a screw connection.

FIGS. 2*a* to 2*d* show the arrangement according to the invention in operation. M designates a magazine with carton blanks stacked therein. Z designates the uppermost carton blank just removed from the stack. The stacked carton blanks run at least more or less vertically or, as is illustrated here, are inclined in the direction of the arrangement at a small angle in relation to the vertical and, as they are shifted, are brought into an at least more or less horizontal position.

Figure 2B:
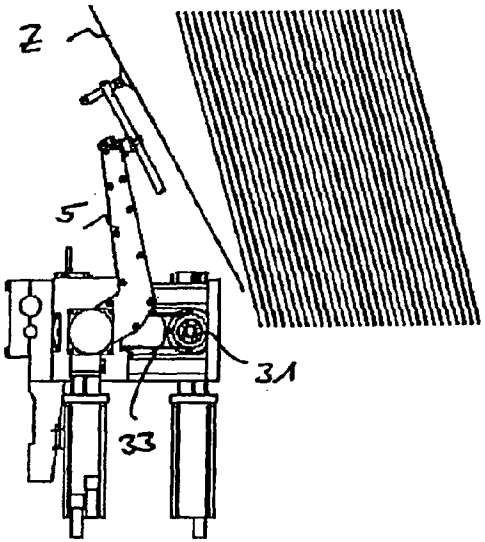
FIG. 2*b* shows the arrangement according to FIG. 1*a* in a second position.
Figure 2C:
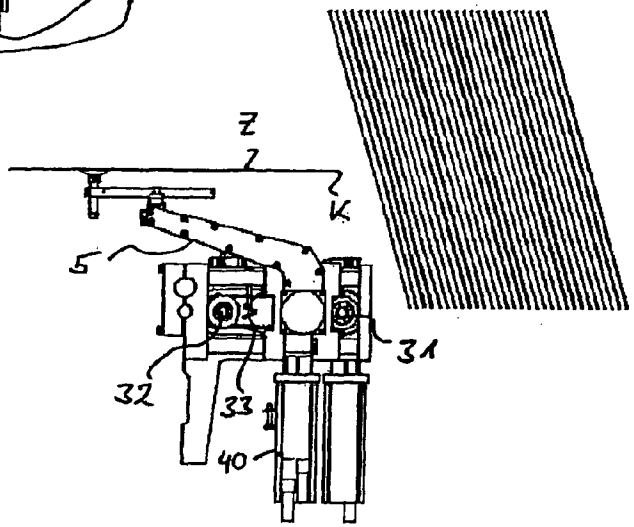
FIG. 2*c* shows the arrangement according to FIG. 1*a* in a third position.
Figure 2A:
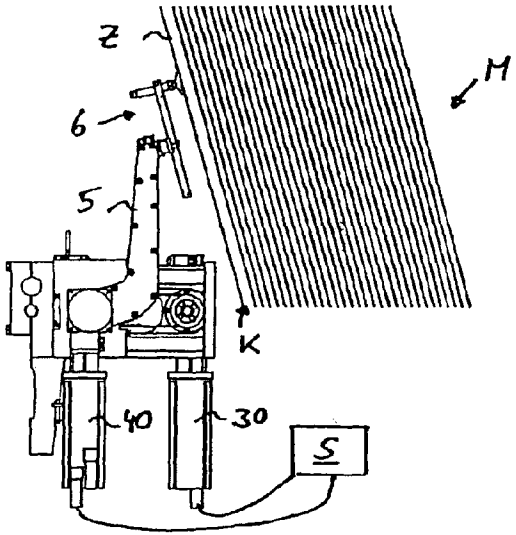
FIG. 2*a* shows a side view of the arrangement according to FIG. 1*a* in a first position.
Figure 2D:
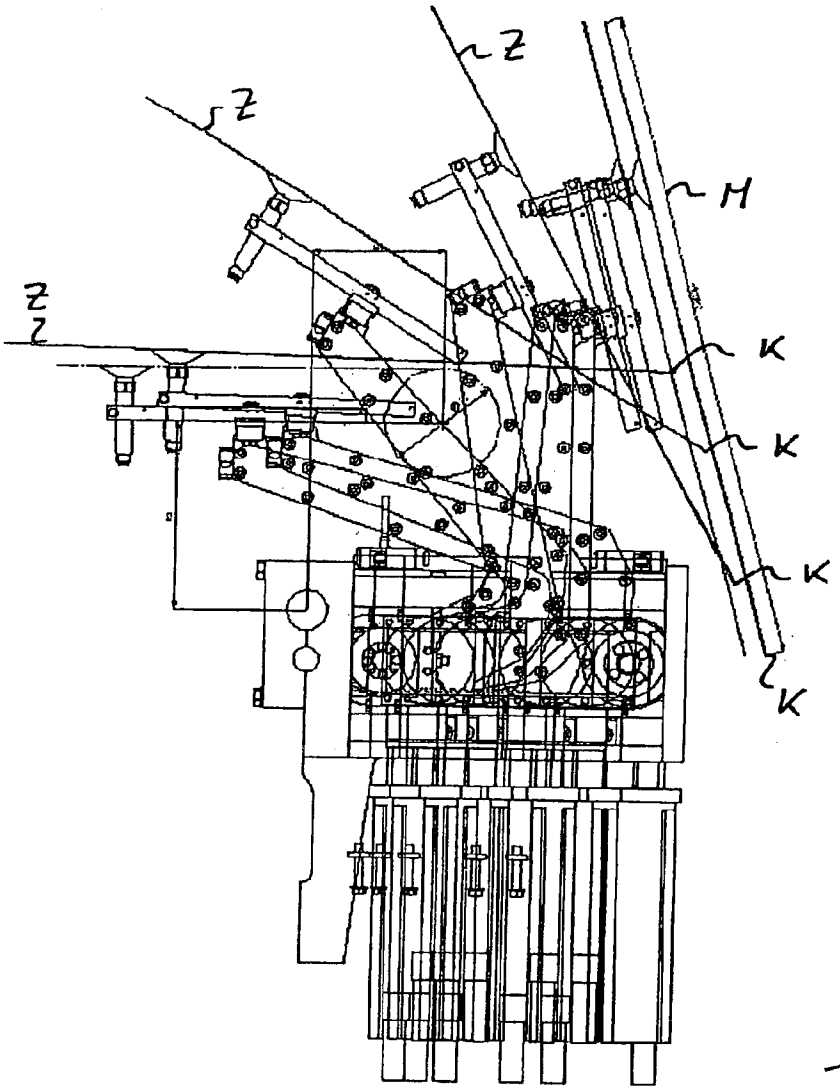
FIG. 2*d* shows different positions superposed.

As can be seen in FIG. 2*a*, the pivoting arm 5 is pivoted up and the suction cups 64 are brought into abutment against the foremost carton blank Z, in order to remove this carton blank Z. The carriage 2 is then moved a short distance away from the top surface of the stack in order to withdraw the carton blank Z, as is illustrated in FIG. 2*a*. Immediately following this withdrawal movement, the arm 5 starts to pivot. During the subsequent pivoting movement, the carriage 2 is moved again in the direction of the top surface of the stack, as can be seen in FIG. 2*b*. It can be seen in FIG. 2*c* that the carriage 2 moves ever closer to the top surface of the stack the more the arm 5 shifts the carton blank Z and the latter approaches the at least more or less horizontal transfer position. In the transfer position, the carton blank Z is usually deposited on a conveyor, and by virtue of the pressure being raised, released from the vacuum sucker. In FIG. 2*d*, the movement sequence has been frozen in individual positions, which are illustrated in superposed form. It can be seen that the pivoting movement of the pivoting arm 5 and the rectilinear movement of the carriage 2 are superposed, the carriage 2 first of all being moved away from the stack and then being moved toward it. In this case, the lowermost edge K of the carton blank Z is always located as closely as possible to the top surface of the stack. It is worth noting that, for this specific and space-saving shifting operation, no vertical translatory displacement of the pivoting arm 5 is necessary. If the transfer location is located further away, for example on a conveyor, then the carriage 2 can subsequently be displaced by the desired distance without any pivoting movement of the arm 5.

Figure 3B:
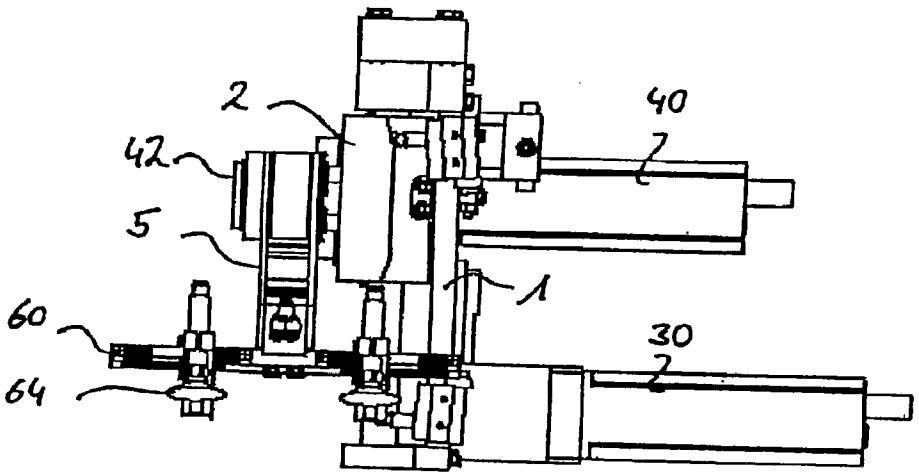
FIG. 3*b* shows the arrangement according to FIG. 3*a* from above.
Figure 3A:
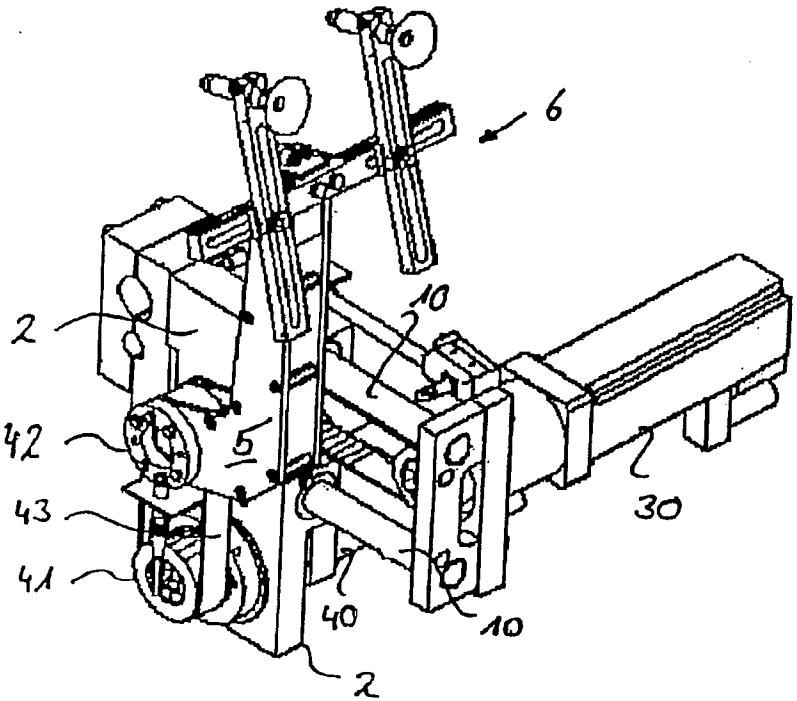
FIG. 3*a* shows a perspective illustration of a second embodiment of the separating arrangement according to the invention.

FIGS. 3*a* and 3*b* illustrate a second exemplary embodiment. This is constructed in essentially the same way as the first example. The same parts have thus been provided with the same designations and will not be described in detail here. The significant difference is that, in this case, the motors 30, 40 are oriented horizontally. Deflection is no longer required for the carriage drive. The drive roller 31 may be connected directly to the motor shaft. In contrast, the rotary drive unit 4 here has a second drive roller 41, which is connected to the motor shaft of the second motor 40, a second deflecting roller 42 and a second endless belt 43, which connects the two rollers. Here too, use is preferably made of a toothed-belt drive. The two rollers 41, 42 are mounted in the carriage 2. In both exemplary embodiments, the second motor 40 is moved along with the carriage 2.

It is also possible, however, to have embodiments in which the rotary drive unit is arranged separately from the carriage and is not displaced along therewith.

It is preferred for the carton blanks to be oriented at least more or less vertically and to be shifted into an at least more or less horizontal position. Other arrangements, however, are also possible. For example, the pivoting arm 5 may also be pivoted through an angle which is greater than or less than the angle of 90° shown here. The displacement direction of the carriage 2 is also selected in accordance with the arrangement of the stack and the desired orientation of the transfer position. It is thus also possible for it to run along a slanting plane or to run vertically. In the case of a horizontal transfer position, the axis of rotation is preferably located at a lower level than this position, with the result that it does not collide with other machine components and the pivoting angle is minimized. In a different location of the transfer position, the axis is arranged analogously. Furthermore, in order to reduce mass and/or specifically to increase rigidity, it is possible to use moving parts for the arrangement which are made of composite materials, e.g. fiber-reinforced plastics or, in particular, carbon-fiber-reinforced plastics.

FIGS. 4 and 5*a* to 5*e* illustrate a third embodiment, which includes parts of the abovementioned variants. For example, the rotary drive unit 4 is arranged in a fixed position and does not move along with the carriage 2. A connecting rod 44 is provided in order to transmit the rotary movement of the drive motor of the rotary drive unit 4 to the pivoting arm 5. It can be seen in FIGS. 5*a* to 5*e* that, here too, the carriage 2 is moved transversely in the forward or rearward direction, depending on the destacking position, and that a corresponding pivoting movement of the pivoting arm 5 is superposed. The displacement direction of the carriage 2 is preferably in a slanting plane here, the carriage assuming its highest position adjacent to the magazine M.

Figure 4:
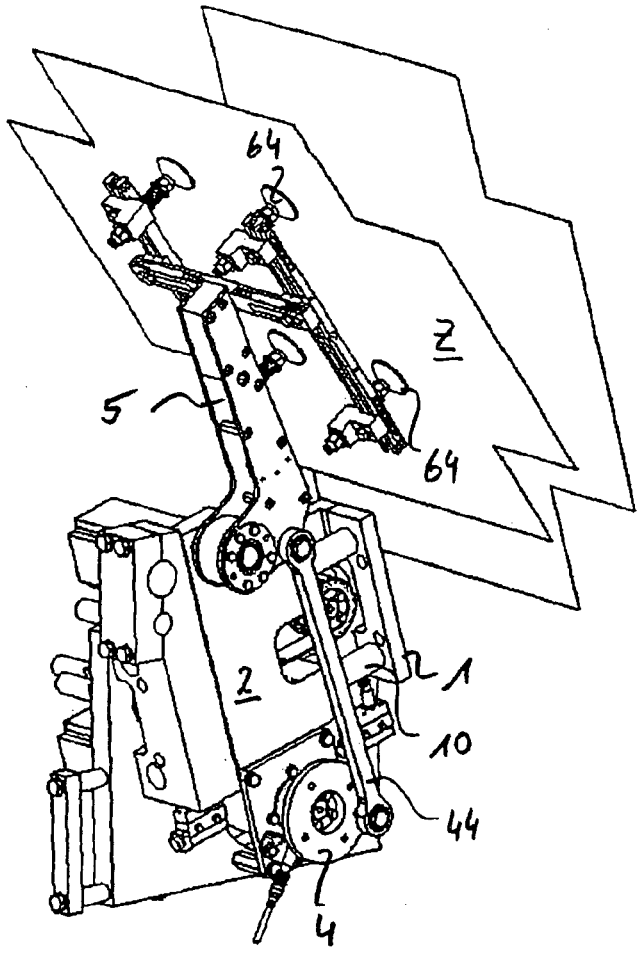
FIG. 4 shows a perspective illustration of a third embodiment of the separating arrangement according to the invention.

In the embodiment which is illustrated in FIG. 4, at least four, preferably precisely four, vacuum suckers 64 are arranged on the pivoting arm 5. For this purpose, in each case two vacuum suckers 64 are arranged, such that they can be displaced relative to one another, at each end of a sucker strip 62. Using at least four vacuum suckers has the advantage that the carton blanks Z are retained and guided in a reliable manner. Destacking in particular is simplified as a result.

Figure 6:
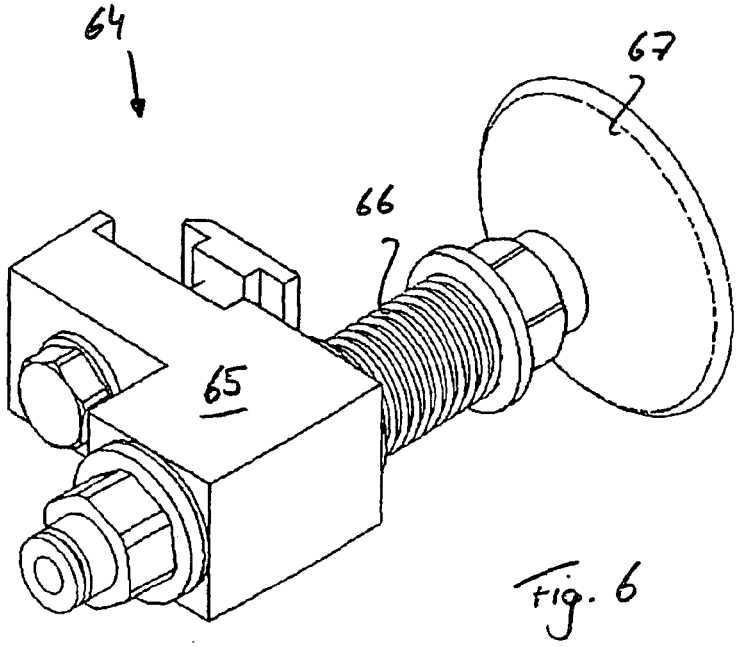
FIG. 6 shows a perspective illustration of a preferred embodiment of a vacuum sucker.
Figure 5C:
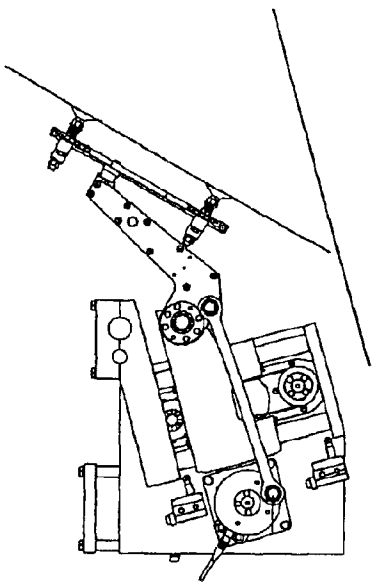
FIG. 5*c* shows the arrangement according to FIG. 4 in a third position.
Figure 5B:
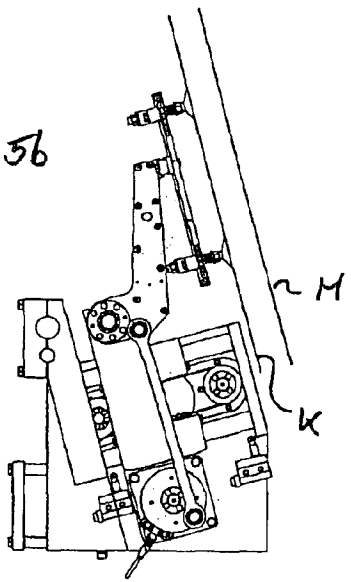
FIG. 5*b* shows the arrangement according to FIG. 4 in a second position.
Figure 5A:
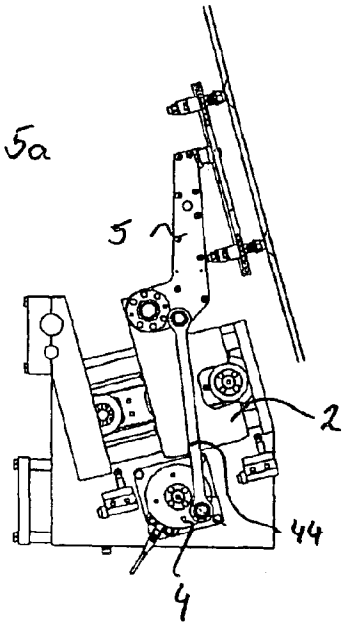
FIG. 5*a* shows the arrangement according to FIG. 4 in a first position.
Figure 5E:
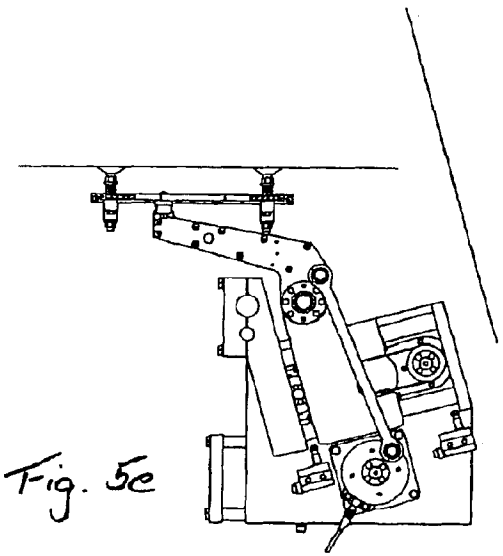
FIG. 5*e* shows the arrangement according to FIG. 4 in a fifth position.
Figure 5D:
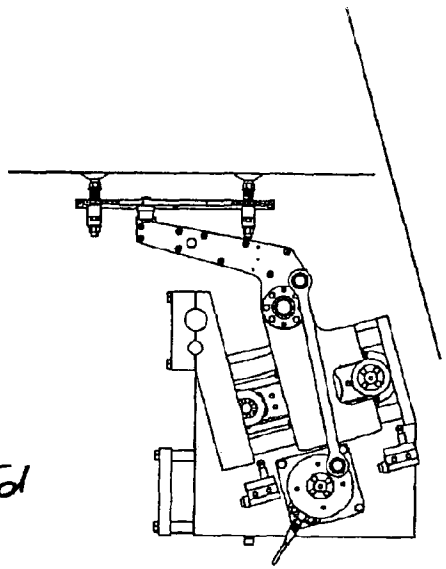
FIG. 5*d* shows the arrangement according to FIG. 4 in a fourth position.

FIG. 6 illustrates a preferred embodiment of a vacuum sucker 64. It has a fastening block 65, for releasable fastening on the sucker strip 62, and a suction head 67, which is fastened resiliently thereon via a spring 66. The resilient design of the vacuum sucker 64 simplifies the operation of withdrawing the carton blank Z from the stack since it is possible to bridge tolerances in the advancement of the carriage and reliable abutment of all the suction cups against the carton blank Z is ensured.

The arrangement according to the invention thus allows space-saving and efficient shifting of individual carbon blanks and, in addition, can be integrated in a flexible manner in cartoning machines.

The disclosures in Swiss patent applications No. 2002 1461/02 filed Aug. 27, 2002 and No. 2002 1825/02 filed Oct. 30, 2002 are hereby incorporated by reference.

What is claimed is:

1. A separating arrangement for a cartoning machine for the individual removal of carton blanks from a magazine and for shifting the removed carton blank from a removal position into a transfer position, the arrangement comprising a motor-driven pivoting arm and means arranged thereon for individually removing the carton blank from the magazine, wherein the pivoting arm is arranged on a carriage which can be displaced in a rectilinear manner, such that, as the carton blank is removed and shifted, a pivoting movement of the pivoting arm and rectilinear movement of the carriage towards and away from the magazine occur simultaneously, wherein the pivoting arm has a first leg and a second leg that form an angle, the first leg being pivotably mounted on the carriage and the second leg being provided with said means for individually removing said carton blank.

2. The arrangement as claimed in claim 1, wherein the transfer position is substantially horizontal, and wherein the carriage can be displaced back and forth in substantially a horizontal direction.

3. The arrangement as claimed in claim 1, wherein the pivoting arm is rigid.

4. The arrangement as claimed in claim 1, wherein the means arranged on the pivoting arm, for individually removing the carton blank from the magazine, can be displaced and fixed in relation to the pivoting arm.

5. The arrangement as claimed in claim 4, wherein the means for individually removing comprise a sucker mount with a carrier bar, which is firmly connected to the pivoting arm, and at least one sucker strip, which is arranged such that it can be displaced and fixed on the carrier bar, wherein each of the at least one sucker strip has at least one vacuum sucker.

6. The arrangement as claimed in claim 5, wherein the arrangement comprises two of said at least one sucker strip and wherein each of these two sucker strips comprises a vacuum sucker.

7. The arrangement as claimed in claim 1, wherein the pivoting arm can be pivoted by means of a driving device, which is arranged on the carriage.

8. The arrangement as claimed in claim 1, wherein the carriage is operated by means of an endless belt, the endless belt being driven by means of a driving device.

9. The arrangement as claimed in claim 1, wherein a control means is provided, this coordinating the movements of the carriage with the pivoting movements of the pivoting arm.

10. The arrangement as claimed in claim 1, wherein the pivoting arm and the carriage are driven cyclically.

11. The arrangement as claimed in claim 1, wherein the carriage first is moved away from the magazine and then is moved toward the magazine as the arm is pivoted and the carton blank is removed.

12. The arrangement as claimed in claim 1, wherein the pivoting arm can be pivoted by means of a servomotor, which is arranged on the carriage, and has a vertical drive shaft.

13. The arrangement as claimed in claim 1, wherein the carriage is operated by means of an endless belt, the endless belt being driven by a driving device with a vertical drive shaft.

14. A separating arrangement for a cartoning machine for the individual removal of carton blanks from a magazine and for shifting the removed carton blank from a removal position into a transfer position, the arrangement comprising a motor-driven pivoting arm and means arranged thereon for independently removing the carton blank, wherein the pivoting arm is arranged on a carriage that is displaceable in a rectilinear manner such that, as the carton blank is being removed and shifted, a pivoting movement of the pivoting arm occurs simultaneously with a rectilinear movement of the carriage such that, the carriage first moves away from the magazine and then moves toward the magazine as the pivoting arm pivots and removes the carton blank.

* * * * *